US008118632B2

(12) United States Patent
De Baan et al.

(10) Patent No.: US 8,118,632 B2
(45) Date of Patent: Feb. 21, 2012

(54) TANKER LOADING ASSEMBLY

(75) Inventors: Jacob De Baan, Maassluis (NL); Johannes Cornelis Perdijk, Voorburg (NL); Bart Steuten, Haarlem (NL)

(73) Assignee: Bluewater Energy Services, B.V., Hoofddorp (NL)

( * ) Notice: Subject to any disclaimer, the term of this patent is extended or adjusted under 35 U.S.C. 154(b) by 794 days.

(21) Appl. No.: 12/095,272

(22) PCT Filed: Nov. 27, 2006

(86) PCT No.: PCT/EP2006/068954

§ 371 (c)(1),
(2), (4) Date: Aug. 7, 2008

(87) PCT Pub. No.: WO2007/063050

PCT Pub. Date: Jun. 7, 2007

(65) Prior Publication Data

US 2008/0310937 A1 Dec. 18, 2008

(30) Foreign Application Priority Data

Nov. 29, 2005 (EP) ..... 05111439

(51) Int. Cl.
*B63B 21/50* (2006.01)
*B63B 22/02* (2006.01)
*B63B 27/24* (2006.01)

(52) U.S. Cl. ..... 441/4; 114/230.12; 137/615; 141/387

(58) Field of Classification Search ..... 114/230.1, 114/230.12, 230.13; 441/3–5; 137/615; 141/279, 387, 388; 166/352, 355
See application file for complete search history.

(56) References Cited

U.S. PATENT DOCUMENTS

| | | | | |
|---|---|---|---|---|
| 3,590,767 | A | 7/1971 | Dunbar | |
| 3,922,992 | A | 12/1975 | Wilbourn | |
| 5,044,297 | A * | 9/1991 | de Baan et al. | 114/293 |
| 5,275,510 | A | 1/1994 | De Baan | |
| 5,306,186 | A | 4/1994 | Boatman | |
| 5,316,509 | A | 5/1994 | Boatman et al. | |
| 5,456,622 | A * | 10/1995 | Breivik et al. | 441/3 |
| 5,540,607 | A | 7/1996 | Breivik | |

(Continued)

FOREIGN PATENT DOCUMENTS

CA 2248578 A1 3/2000

(Continued)

OTHER PUBLICATIONS

Official Search Report of the European Patent Office in counterpart foreign application No. PCT/EP2006/068954 filed Nov. 27, 2006.

(Continued)

*Primary Examiner* — Ajay Vasudeva
(74) *Attorney, Agent, or Firm* — Steven M. Koehler; Westman, Champlin & Kelly, P.A.

(57) ABSTRACT

Tanker loading assembly includes a first on-board hose arrangement with first coupling portion and a second submerged buoyant hose arrangement provided with second coupling portion for cooperation with the first coupling portion for obtaining a fluid-tight connection between the first and second hose arrangements. The first coupling portion is positioned in an internal vertical passage of the tanker, wherein a lifting device is provided for engaging the second coupling portion and lifting it towards the position for engaging the first coupling portion.

21 Claims, 6 Drawing Sheets

U.S. PATENT DOCUMENTS

| | | | | | |
|---|---|---|---|---|---|
| 5,545,065 | A | * | 8/1996 | Breivik et al. | 441/5 |
| 5,823,131 | A | * | 10/1998 | Boatman et al. | 114/230.12 |
| 6,109,830 | A | * | 8/2000 | de Baan | 405/170 |
| 6,113,314 | A | * | 9/2000 | Campbell | 405/224 |
| 6,155,193 | A | * | 12/2000 | Syvertsen et al. | 114/230.12 |

FOREIGN PATENT DOCUMENTS

| | | | | |
|---|---|---|---|---|
| GB | 2282583 | A | | 4/1995 |
| WO | WO 93/24733 | A | | 12/1993 |
| WO | WO 94/02351 | A | | 2/1994 |
| WO | WO 9404412 | A1 | * | 3/1994 |
| WO | WO 9630253 | A1 | * | 10/1996 |

OTHER PUBLICATIONS

Written Opinion of the European Patent Office in counterpart foreign application No. PCT/EP2006/068954 filed Nov. 27, 2006.

* cited by examiner

TANKER LOADING ASSEMBLY

CROSS-REFERENCE TO RELATED APPLICATION

This application is a Section 371 National Stage Application of International Application PCT/EP2006/068954 filed Nov. 27, 2006 and published as WO 2007/063050 in English.

BACKGROUND

The invention relates to a tanker loading assembly, comprising a first on-board hose arrangement with first coupling portion and a second submerged buoyant hose arrangement provided with second coupling portion for cooperation with the first coupling portion for obtaining a fluid-tight connection between the first and second hose arrangements.

Tanker-loading offshore, whereby a dynamically positioned tanker is employed, is a well establish practice. In general, such tankers are fitted out such that that they are able to arrive at a designated location at sea, position themselves in a stable mode, pick up the second coupling portion which is attached at one end of a tethered submerged buoyant hose arrangement, and connect this second coupling portion to the mating on-board first coupling portion.

Picking up the second coupling portion is often a process involving manual labour due to need to pick up messenger wires and to connect these to winches on the ship. Since the working on open decks of vessels, particularly in freezing or high wave conditions is dangerous, it is obvious that a fairly low operability is achieved in the more onerous seas such as the North Sea, for example.

The other end of the hose arrangement which is permanently attached to an oil or gas production facility, allows the oil or gas to flow into the tanker. During this operation the tanker maintains its position by appropriate means (e.g. its DP capability).

One such hose arrangement, to work in conjunction with a DP tanker, is described in U.S. Pat. No. 5,275,510 "Offshore Tanker Loading System".

A complication occurs if such operation is to be performed in ice infested waters. Particularly if significant ice sheets and smaller and larger iceberg bits are present, the damage potential of the hose arrangement is very high if such hose arrangement is connected to the tanker at some over the side position. One logical solution would be to pull in the hose into a moonpool created inside the tanker hull boundaries where ice sheet cannot get. It has been observed in testing however that ice sheets, when they break up under the action of the vessel moving relative to the ice, also often slip under the bottom plate of the hull. Therefore any hose parts exiting downwardly from a moonpool through the tanker bottom, also risks being damaged by ice sheets.

SUMMARY

In a first aspect of the invention it is an objective to provide a solution for the protection of the hoses exiting the bottom of the tanker, to provide an easy pick up of the second coupling portion and to simplify its connection to the on-board mating first coupling portion.

In a second aspect of the invention it is also an objective of the invention to provide a second hose arrangement layout/geometry which provides a maximum of tanker excursion opportunity. This in turn allows the tanker to continue to break the ice sheets by moving continuously in the operating area by "trashing" around and avoid being caught in ice sheets of larger extent which, due to changing sea currents, may drift in directions not aligned with the longitudinal axis of the tanker.

Tankers of such ice breaking design and capability already exist, and in another aspect of the invention, a further objective of this invention is therefore to be able to maximise the efficiency of these tankers when being deployed at oil loading terminals in ice infested waters.

In yet another aspect of the invention, it is also an objective of the invention to create a flexible hose arrangement having a very high throughput, such that the tanker need not be exposed to severe offshore ice conditions for a long period of loading.

In accordance with an aspect of the present invention the first coupling portion is positioned in an internal vertical passage of the tanker, wherein a lifting device is provided for engaging the second coupling portion and lifting it towards the position for engaging the first coupling portion. This enables a safe and easy pick-up of the second coupling portion and connection to the first coupling portion.

In an embodiment the lifting device comprise a casing which is movable vertically within the passage and which supports the first coupling portion. As a result the first coupling portion can be lowered to receive the lifted second coupling portion.

In a further embodiment, the submerged hose arrangement comprises a pick-up buoy positioned above the second coupling portion and connected therewith by a cable, and wherein the lifting device further comprise a gripping device for gripping the cable. This combination of components provides a stable positioning of the second hose arrangement during the pick-up.

In this embodiment, the lifting device engages and lifts the pick-up buoy. This offers the possibility of lifting the second coupling portion through the pick-up buoy.

When, in accordance with yet another embodiment of the invention, the casing comprises a guiding and latching arrangement for the second coupling portion, the second coupling portion can be stabilised for connecting it to the first coupling portion.

In an embodiment, the first coupling portion is horizontally displaceable relative to the casing. Thus it can be moved out of the way of the lifting device lifting the pick-up buoy.

Further, in an advantageous embodiment the second hose arrangement comprises at least one fluid line describing at least partially an inverted catenary shape and creating a connection to the seabed. This allows the tanker to move around sufficiently for breaking ice, if needed.

Then it is possible that each fluid line having the inverted catenary shape is connected to a ballast block positioned below the second coupling portion and connected thereto by means of a respective intermediate fluid line. In a disconnected situation the ballast block rests on the seabed. In the connected situation the ballast block is lifted from the seabed.

The ballast block and second coupling portion further are connected by a cable which is shorter then the intermediate fluid line. This diminishes or eliminates loads on each intermediate fluid line.

Hereinafter the invention will be explained further by reference to the drawings schematically showing an embodiment of the invention.

DETAILED DESCRIPTION

Figure 1:
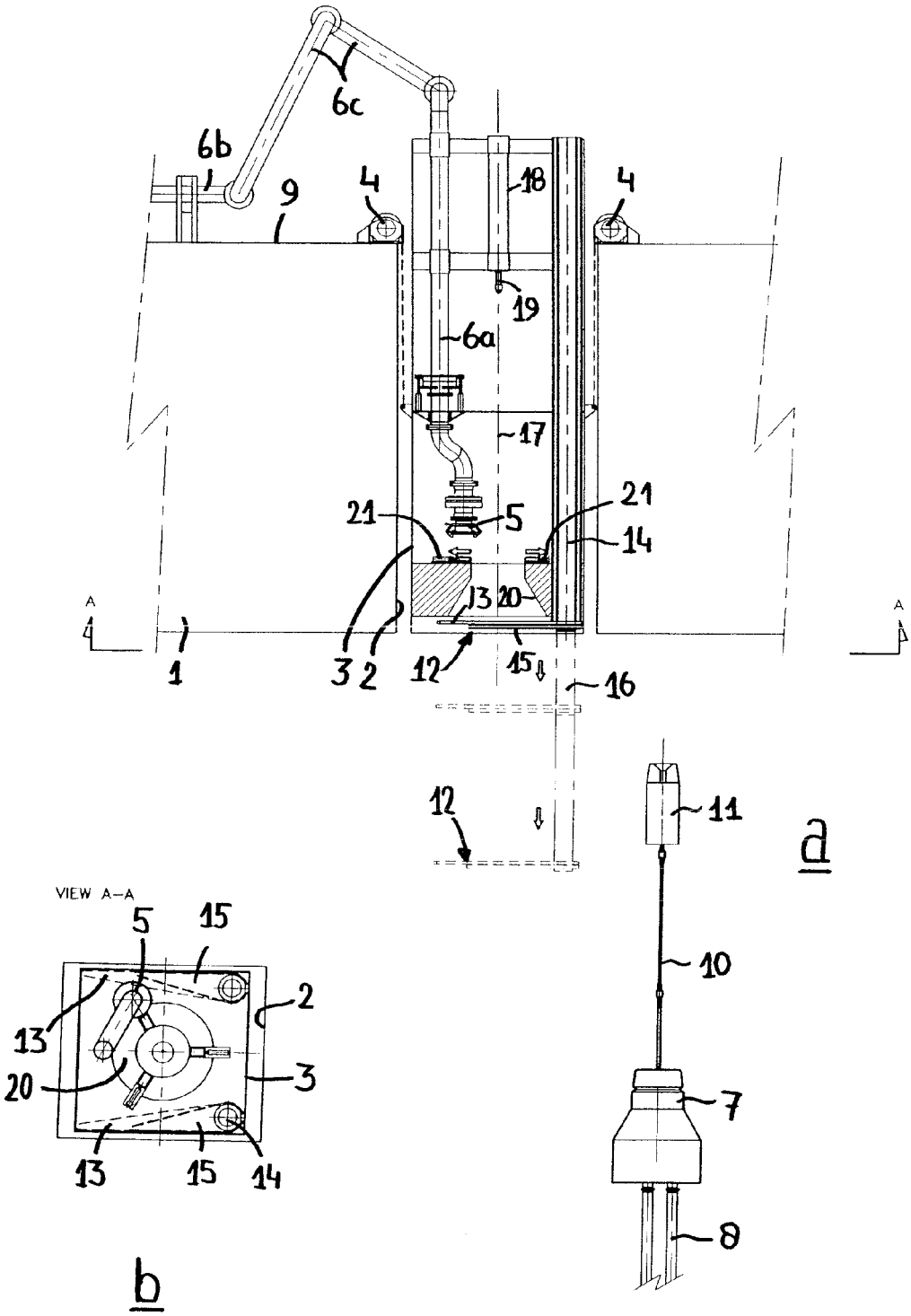
FIGS. 1-5 show an embodiment of the assembly according to the invention during five successive operational stages, each in a schematical side elevational view (a) and a schematical vertical view (b)

The tanker hull 1 is provided with a passage 2 (a so-called moonpool) in which a casing 3 is vertically movable. The moonpool 2 and casing 3 are generally conforming in cross-section which may be round, or square as shown in the figures.

The casing 3 is able to be positioned by appropriate auxiliary devices 4 (e.g. hoisting cables) in any predefined elevated position. In its lowest position (as will be described later in detail) a first coupling portion 5 of a first hose arrangement 6 can be coupled with a second coupling portion 7 of a second, submerged buoyant hose arrangement 8 to allow the flow of oil or gas. This lowest position may be 5 to 20 meters below the keel of the vessel.

The first hose arrangement comprises a first part 6*a* connected to the first coupling portion 5 with a fixed vertical position relative to the casing 3, a second part 6*b* connected to the deck 9 of the tanker and a flexible part 6*c* (here an articulated part) connecting the first and second parts, such as to allow unimpeded movement of the casing 3 in the tanker moonpool 2.

In its highest position, the casing 3 can be locked to the hull 1 (by a locking device not shown) for normal sea voyage. This highest position may be between 0 and 10 metres above the vessel keel. As will be described later, an intermediate elevation for the lower end of the casing 3 is selected during a pick-up of the second coupling portion 7.

This second coupling portion 7 is provided with a very short section of cable or messenger wire 10, to the free end of which a pick-up buoy 11 is connected.

The lower side of the casing 3 further is provided with a mobile lifting fork 12, in one embodiment, of a foldable nature to allow storage in or adjacent to the casing 3. This fork 12 comprises two gripping arms 13 pivotable around respective vertical axes 14, and two separately pivotable guiding sections 15. This fork 12 is attached to a vertically extendable casing part 16 and thus can be deployed further downward than the casing 3 to engage the messenger wire 10. The fork 12 has in its deployed position an open side (between the guiding sections 15) of some 6 meters or more. Near its closed end (at the tips of the gripping arms 13 in the gripping position) it is located under the vertical centreline 17 of the casing 3. The fork 12 at its open end may also be fitted with a catch (not illustrated) which prevents the wire 10 disengaging from the fork, once caught in it.

A lifting jack 18 is mounted in the casing 3 and has an extendable piston rod 19 for engaging the pick-up buoy 11.

The casing 3 further is provided with a tapering guiding and latching arrangement with a tapering channel 20 and latches 21 at its top for engaging counter parts (not shown) on the second coupling portion 7.

The first coupling portion 5 is displaceable horizontally relative to the casing 3, for example by a pivotal movement.

FIG. 1 shows the starting position in which the tanker approaches the second hose arrangement 8. The casing 3 is retracted into the moonpool 2 and the casing part 16 is retracted into the casing 3. The lifting fork 12 is in a storage position within the boundaries of the casing 3 (see FIG. 1*b*).

Figure 2:
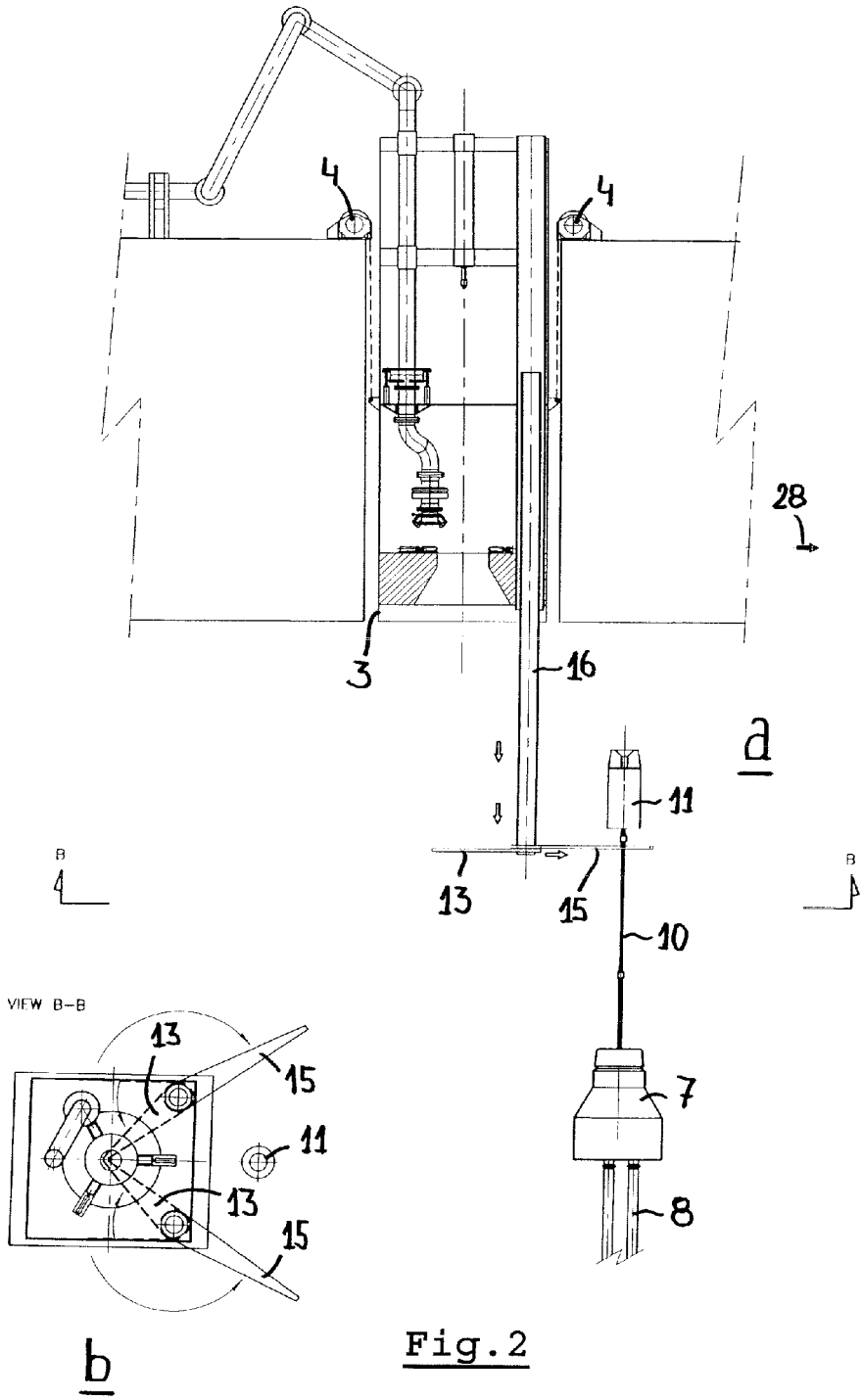

Next, FIG. 2, the casing part 16 is lowered and the fork 12 is brought in a position in which the guiding sections 15 define a narrowing guiding channel for the messenger wire 10 and wherein the tips of the gripping arms 13 are in a touching relation. The vessel drift direction is indicated by arrow 28.

Figure 3:
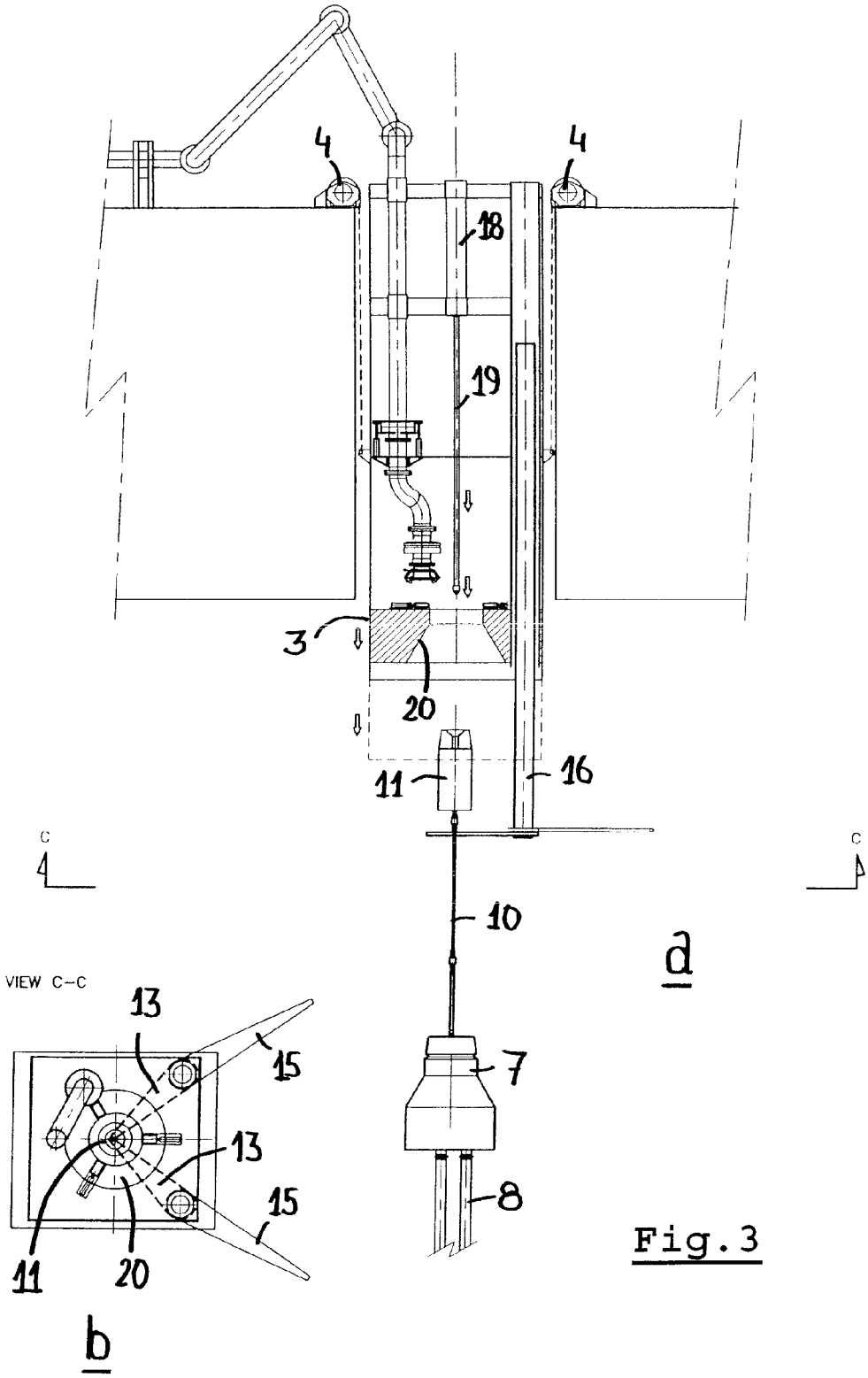

Once the messenger wire 10 is caught in the fork 12 and centred under the casing 3 (FIG. 3), the casing is lowered (by its auxiliary devices 4) such that the pick-up buoy 11 enters the casing 3 through the tapering or funnel shaped channel 20. The fork 12 may be retracted to its storage position shortly before the buoy 11 passes the channel 20.

Figure 4:
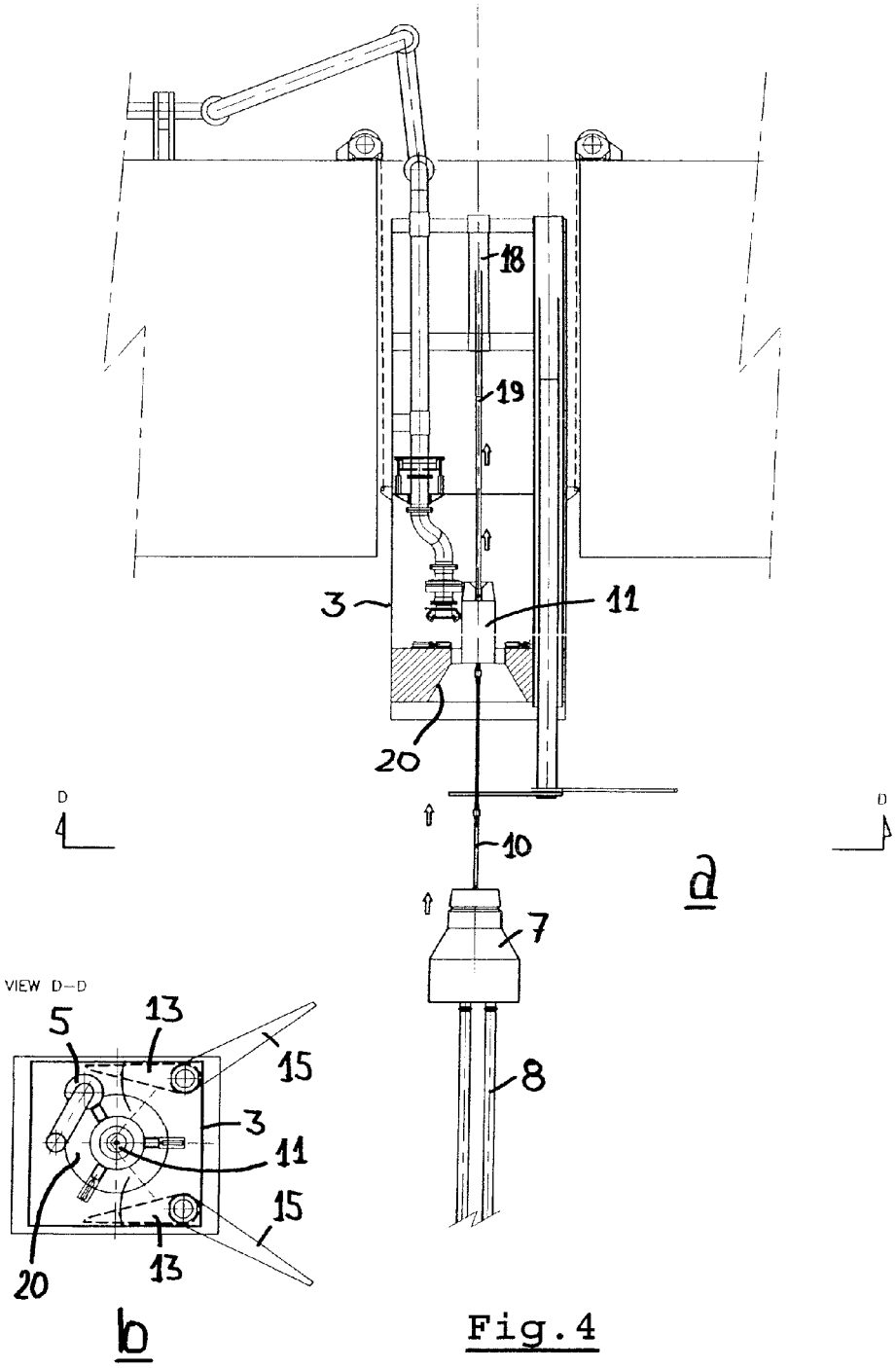
Figure 5:
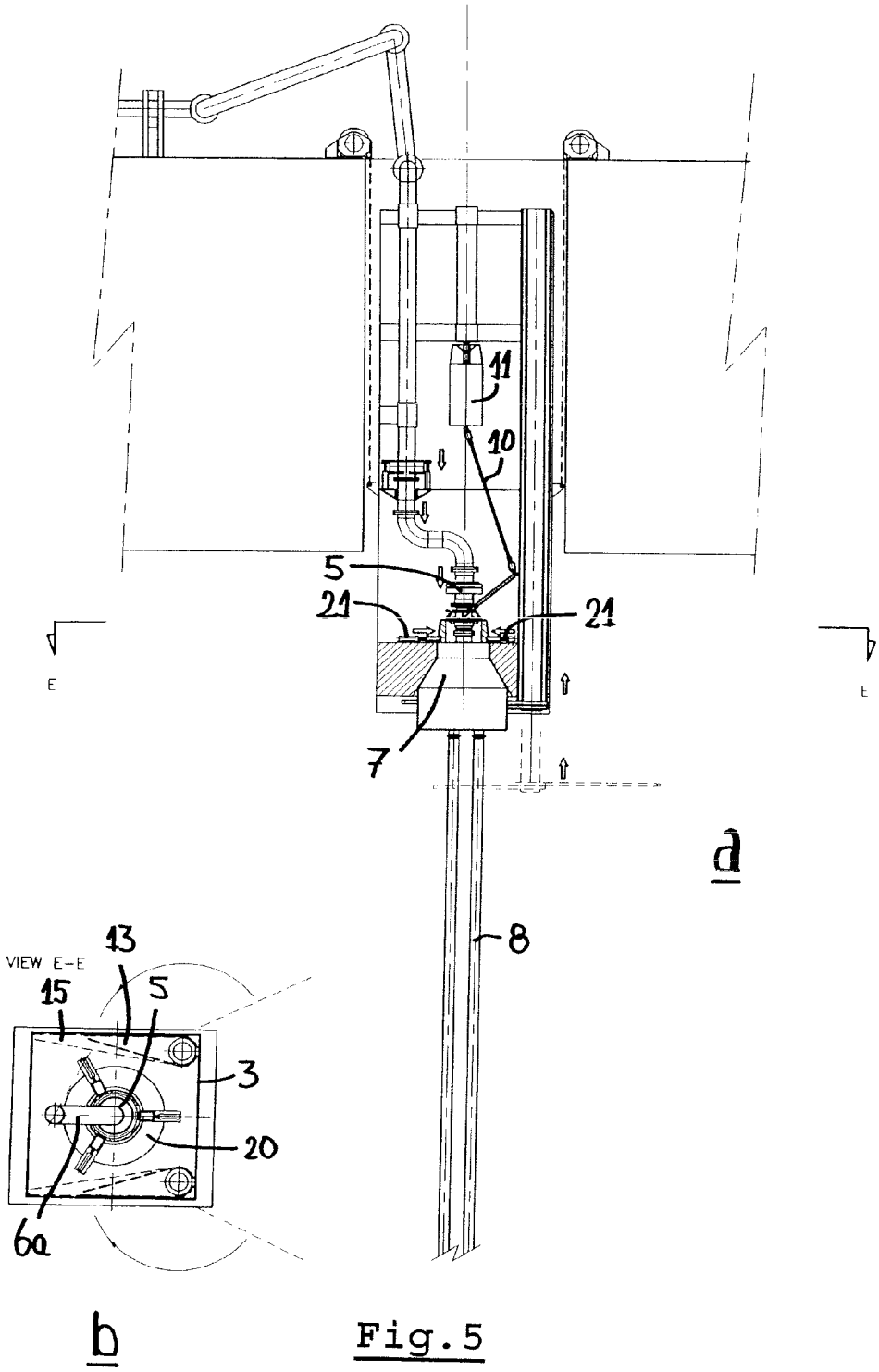

Simultaneously or next, the hydraulically operated jack 18 lowers its piston rod 19 (FIG. 3) and latter engages the top of the pick-up buoy 11 by a latching device (not illustrated). This jack 18 then lifts the pick-up buoy 11 (FIG. 4) and with it the entire second hose arrangement 8 with second coupling portion 7. The first coupling portion 5 will be displaced to a position aligned with the second coupling portion 7 (FIG. 5*b*) when the pick-up buoy 11 has passed the channel 20 and first coupling portion 5.

When the second coupling portion 7 has been lifted sufficiently it mates with the channel 20 and is latched by the latches 21 and then can be coupled with its mating first coupling portion 5.

The hose connector defined by the first and second coupling portion may be executed as a structural element, including a bearing arrangement to allow the tanker to weathervane while connected to the second hose arrangement.

Advantageously, while the tanker is being loaded, the casing 3 is progressively raised inside the moonpool 2 to adjust the global geometry to the draft increase of the vessel. As such a disconnect, once fully loaded or in an emergency, can be readily executed in a well defined configuration.

Figure 6:
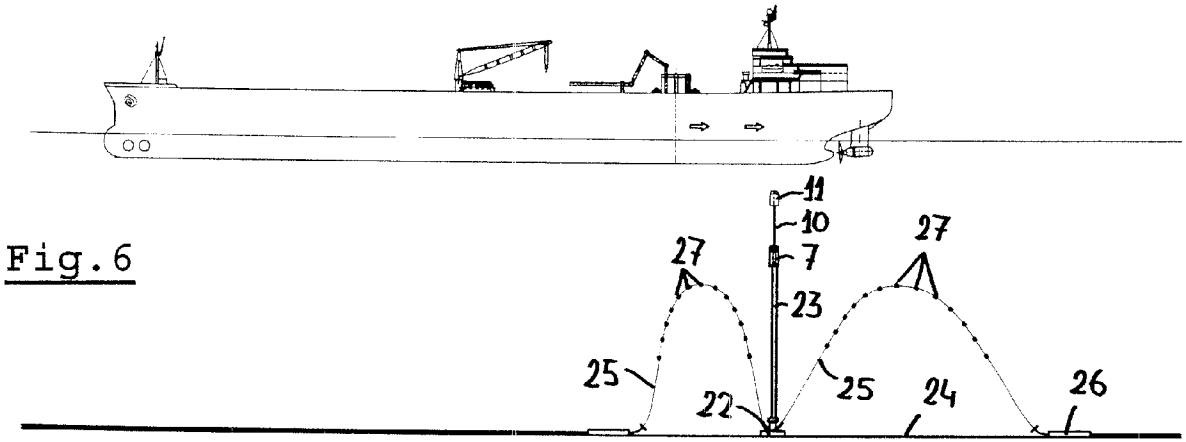
FIG. 6 shows an overall view of a tanker with assembly in a disconnected situation.
Figure 7:
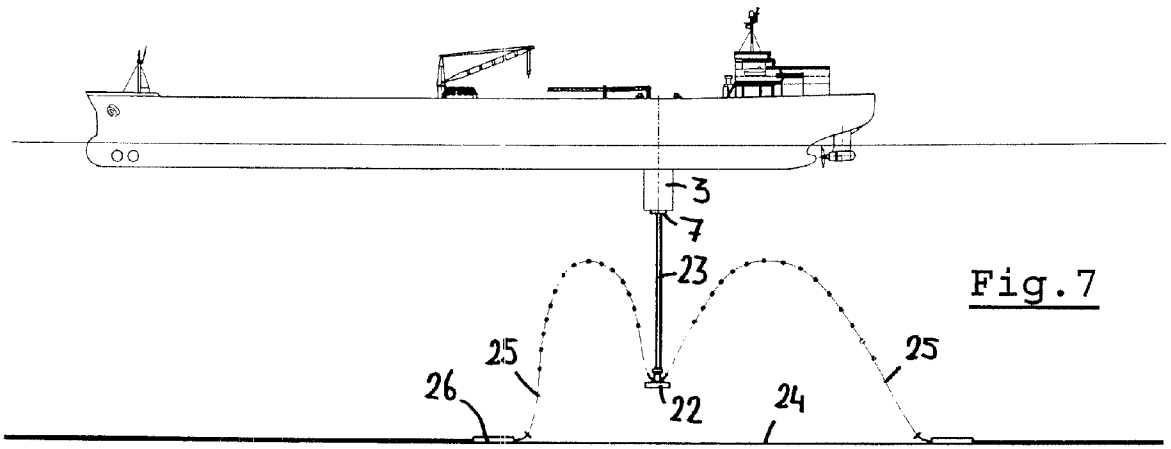
FIG. 7 shows an overall view of a tanker with assembly in a connected situation.

Referring to FIGS. 6 and 7, the second coupling portion 7 is connected to a ballast block 22 resting on the seabed when not in use. The second coupling portion 7 also has connected at its lower end, one, but typically more than one, intermediate fluid lines 23. Each intermediate fluid line 23 is at its lower end connected the ballast block 22. As such, when the system is not in use, the ballast block rests on the seabed 24, the second coupling portion 7 has sufficient buoyancy to maintain itself in a tethered mode whereby a cable (not shown) connecting the ballast block 22 and second coupling portion 7 takes the tether loads and the intermediate fluid lines 23 are generally unstretched. In certain cases the cable may be omitted.

From the ballast block 22, flexible fluid lines 25 run in an inverted catenary to a pipeline end 26 on the seabed. There may be one or more such pipeline ends and inverted catenaries. The catenaries are created by fitting distributed buoyancy modules 27 along the length of the fluid lines 25. By varying the amount and location of such buoyancy modules 27, the configuration can be adapted to suit any depth limit or any ice keel level.

The global geometry of the inverted catenaries and the long vertical riser string (intermediate fluid lines 23) allow the tanker large excursions. The pipeline ends 26 may be located such that the overall system has a strong equilibrium position of a symmetrical nature.

When the system is in use, the ballast block 22 is only free from the seabed 24 by a nominal amount, allowing for a tanker motion in response to waves and any low tides without touching the seabed. This allows an emergency disconnect to be performed in a virtual "free fall" mode.

It is noted that any of the above described features of the system and method of the invention can be used separately or in any suitable combination. Therefore the invention is not restricted to the specific embodiments described which can be varied in a number of ways within the scope of the invention as defined by the appending claims.

The invention claimed is:

1. A tanker loading assembly, comprising a first on-board hose arrangement with a first coupling portion and a second submerged buoyant hose arrangement provided with a second coupling portion releasably coupled with the first coupling portion to obtain a fluid-tight connection between the first and second hose arrangements, wherein the first coupling portion is configured for placement in an internal vertical passage of a tanker, and wherein a lifting device comprises a casing which is movable vertically within the passage and wherein the casing supports the first coupling portion and is configured to engage the second coupling portion and lift the second coupling portion towards a position to engage and support the first coupling portion, and wherein the vertical movement of the casing causes a corresponding vertical movement of the first coupling portion.

2. The tanker loading assembly according to claim 1, wherein the second hose arrangement comprises a pick-up buoy positioned above the second coupling portion and connected therewith by a cable, and wherein the lifting device further comprises a gripping device configured to engage the cable.

3. The tanker loading assembly according to claim 2, wherein the gripping device comprises two opposite gripping arms movable between a gripping position and a release position.

4. The tanker loading assembly according to claim 3, wherein the gripping arms are pivotable around respective vertically extending axes.

5. The tanker loading assembly according to claim 4, wherein each gripping arm comprises a separately pivotable cable guiding section.

6. The tanker loading assembly according to claim 2, wherein the casing includes a vertically extendable casing part, and wherein the gripping device is provided on the vertically extendable casing part.

7. The tanker loading assembly according to claim 2, wherein the lifting device is configured to engage and lift the pick-up buoy.

8. The tanker loading assembly according to claim 7, wherein the lifting device comprises at least one of a piston-cylinder assembly or a hoisting cable.

9. The tanker loading assembly according to claim 1, wherein the casing comprises a guiding and latching arrangement for the second coupling portion.

10. The tanker loading assembly according to claim 9, wherein the guiding and latching arrangement comprises an upwardly tapering channel with latches at its upper end for engaging respective counter parts on the second coupling portion.

11. The tanker loading assembly according to claim 1, wherein the first coupling portion is horizontally displaceable relative to the casing.

12. The tanker loading assembly according to claim 1, wherein the first hose arrangement comprises a first part connected to the first coupling portion with a fixed vertical position relative to the casing, a second part connected to a vessel and a flexible part connecting the first and second parts.

13. The tanker loading assembly according to claim 1, wherein the second hose arrangement comprises at least one fluid line describing at least partially an inverted catenary shape and creating a connection to the seabed.

14. The tanker loading assembly according to claim 13, wherein the at least one fluid line having the inverted catenary shape is connected to a ballast block positioned below the second coupling portion and wherein the at least one fluid line is in fluid communication with a respective intermediate fluid line.

15. The tanker loading system according to claim 14, wherein the ballast block and second coupling portion further are connected by a cable which is shorter then the intermediate fluid line.

16. A vessel having a loading assembly, the loading assembly comprising a first on-board hose arrangement with a first coupling portion releasably engaged with a second coupling portion of a second submerged buoyant hose arrangement, wherein the first coupling portion is positioned in an internal vertical passage of a tanker, and wherein a lifting device comprises a casing which is moveable vertically within the passage and wherein the casing supports the first coupling portion, wherein the vertical movement of the casing causes a corresponding vertical movement of the first coupling portion, and wherein the vertical movement of the casing causes a corresponding vertical movement of the first coupling portion, and wherein the lifting device is configured to engage the second coupling portion and lift the second coupling portion towards a position to engage the first coupling portion.

17. The vessel according to claim 16 wherein the lifting device further comprises a gripping device configured to engage a cable.

18. The vessel according to claim 17, wherein the gripping device comprises two opposite gripping arms movable between a gripping position and a release position.

19. The vessel according to claim 18, wherein the casing includes a vertically extendable casing part, and wherein the gripping device is provided on the vertically extendable casing part.

20. The vessel according to claim 19, wherein the first hose arrangement comprises a first part connected to the first coupling portion with a fixed vertical position relative to the casing, a second part connected to the vessel and a flexible part connecting the first and second parts.

21. A loading assembly for loading a fluid onto a floating vessel, the assembly comprising:

a first hose arrangement comprising:

a first coupling portion configured for placement within an internal vertical passage of the vessel;

a first part connected to the first coupling portion;

a second part connectable to the vessel; and a flexible portion attached to the first and the second part and allowing the first part to be moved vertically without disconnecting the first part from the second part;

a second submerged buoyant arrangement provided with a second coupling portion releasably coupleable with the first coupling portion to obtain a fluid-tight connection between the first and second coupling portions; and a lifting device comprising a casing which is configured to be movable vertically within the passage and wherein the casing supports the first coupling portion in a fixed vertical position within the casing and wherein the casing is configured to engage the second coupling portion and lift the second coupling portion towards a position to engage and support the first coupling portion.

* * * * *